US006457955B1

(12) United States Patent
Cheng

(10) Patent No.: US 6,457,955 B1
(45) Date of Patent: Oct. 1, 2002

(54) COMPOSITE HEAT DISSIPATION FAN

(75) Inventor: Jui-Hung Cheng, Kaohsiung (TW)

(73) Assignee: Yen Sun Technology Corp. (TW)

( * ) Notice: Subject to any disclaimer, the term of this patent is extended or adjusted under 35 U.S.C. 154(b) by 122 days.

(21) Appl. No.: 09/756,661

(22) Filed: Jan. 10, 2001

(51) Int. Cl.[7] ..... F04B 17/00; F04B 35/04

(52) U.S. Cl. ..... 417/423.8; 165/122

(58) Field of Search ..... 417/423.1, 423.8, 417/423.12, 423.15, 354, 313, 366; 415/174.3; 165/122

(56) References Cited

U.S. PATENT DOCUMENTS 4,589,822 A * 5/1986 Clausen et al. ..... 415/174.3
4,773,829 A * 9/1988 Vettori ..... 417/366
5,478,221 A * 12/1995 Loya ..... 417/313
5,967,764 A * 10/1999 Booth et al. ..... 417/423.8
6,125,924 A * 10/2000 Lin ..... 165/122
6,193,478 B1 * 2/2001 Lin et al. ..... 417/423.15
6,309,190 B1 * 10/2001 Chen ..... 417/423.1
6,318,976 B1 * 11/2001 Hsiesh ..... 417/423.12
6,327,145 B1 * 12/2001 Lian et al. ..... 361/697
6,406,274 B1 * 6/2002 Lin et al. ..... 417/354

FOREIGN PATENT DOCUMENTS

JP 2000320496 * 11/2000 ..... F04D/29/52

* cited by examiner

*Primary Examiner*—Teresa Walberg
*Assistant Examiner*—Leonid Fastovsky
(74) *Attorney, Agent, or Firm*—Larson & Taylor, PLC

(57) ABSTRACT

A composite heat dissipation fan, including an impeller having first blades, and the first blades having a periphery combined with second blades for creating a side directed wind supply. The impeller is provided with a magnet ring which is energized with the stator coils of the base plate, so that the impeller is induced to rotate about the rotation shaft of the base plate. The first blades draw the ambient cold air through the wind inlet opening, and the wind outlet opening of the base plate drains the wind outward. The second blades uses part of the cold air to drain wind sideward, thereby providing a multi-directional wind draining effect so as to increase the heat dissipation efficiency.

9 Claims, 7 Drawing Sheets

COMPOSITE HEAT DISSIPATION FAN

BACKGROUND OF THE INVENTION

1. Field of the Invention

The present invention relates to a composite heat dissipation fan, and more particularly to a composite heat dissipation fan which can produce a multi-directional ventilating effect, thereby enhancing the heat dissipation efficiency.

2. Description of the Related Prior Art

A first conventional heat dissipation fan in accordance with the prior art shown in FIG. 1 comprises a base 90 combined with a top plate 91 which defines a wind inlet opening 92, the base 90 having a side wall defining a wind outlet opening 93. The base 90 is combined on a heat emitting member of a central processing unit. When the fan device 94 is rotated, the ambient cold air is drawn into the wind inlet opening 92 on the top of the base 90, so that the attached heat on the bottom of the base 90 combined on a heat emitting body (not shown) is carried by the drawn cold air, and is drained through the wind outlet opening 93 in the side wall of the base 90, thereby dissipating the heat. In practice, the first conventional heat dissipation fan only has a single-side sideward wind draining function, so that only one path is used to carry away the heat produced by the heat emitting body, and cannot have a multi-directional ventilating path including the downward direction and the sideward direction, thereby greatly limiting th e cooling and heat dissipation efficiency.

A second conventional heat dissipation fan in accordance with the prior art shown in FIG. 2 comprises a housing 80 combined with a stator seat 81 which is rotatably provided with an impeller 82, the housing 80 covered by a cover plate 83 which has a wind inlet opening 84 for drawing the cold air, the housing 80 having a wind outlet opening 85 and heat dissipation fins 86 having heat dissipation channels.

The impeller 82 includes upper blades 821, and lower blades 822. Therefore, when the impeller 82 is rotated, it can drive the air flow along the axial direction and along the perpendicular face of the axial center, thereby obtaining a better heat convection and dissipation effect. However, the hub of the impeller 82 has a greater diameter and area, therefore, the lengths of the upper blade 821 and lower blades 822 are limited, thereby limiting the air flow driving effect thereof.

SUMMARY OF THE INVENTION

The primary objective of the present invention is to provide a composite heat dissipation fan which produces a multi-directional ventilating effect and drives a greater air flow, thereby enhancing heat dissipation effect and efficiency.

The present invention provides a composite heat dissipation fan which includes an impeller having first blades, and the first blades having a periphery combined with second blades for creating a side directed wind supply. The impeller is provided with a magnet ring which is energized with the stator coils of the base plate, so that the impeller is induced to rotate about the rotation shaft of the base plate. The first blades draw the ambient cold air through the wind inlet opening, and the wind outlet opening of the base plate drains the wind outward. The second blades uses part of the cold air to drain wind sideward, thereby providing a multi-directional wind draining effect so as to increase the heat dissipation efficiency.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
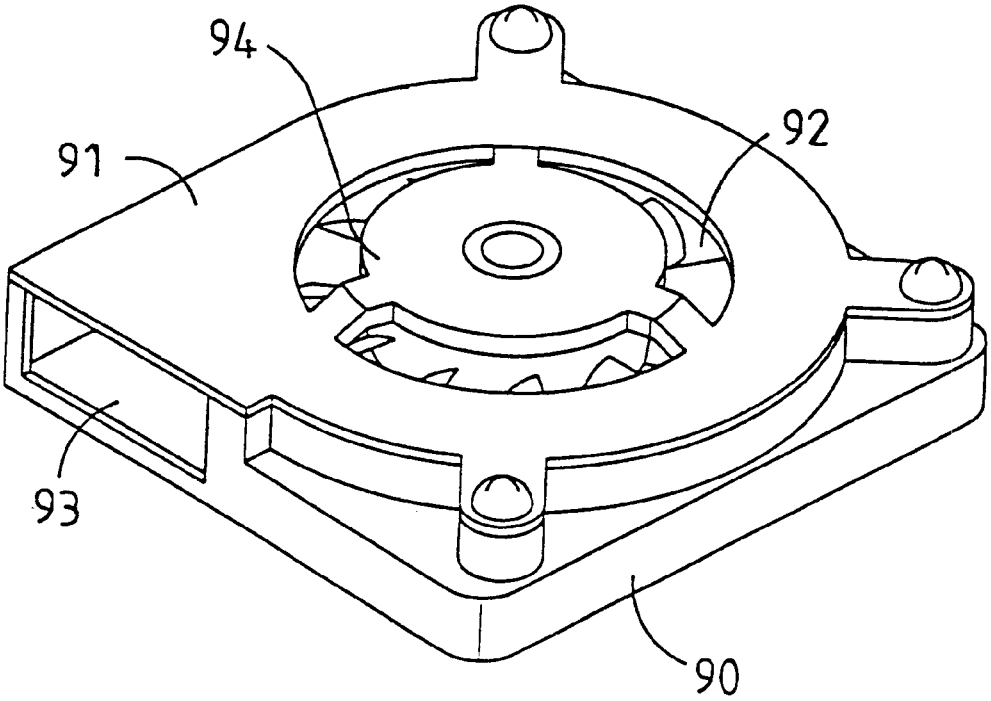
FIG. 1 PRIOR ART
FIG. 1 is a perspective view of a first conventional heat dissipation fan in accordance with the prior art.
Figure 2:
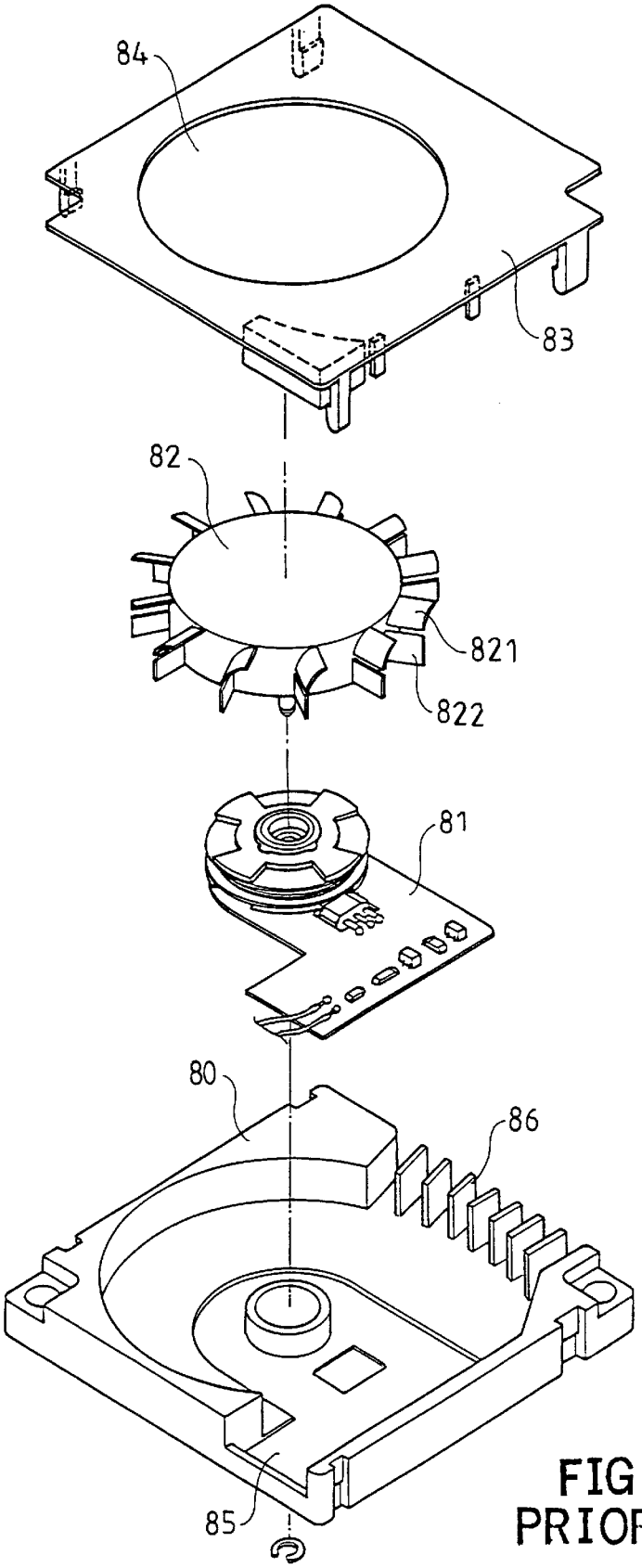
FIG. 2 PRIOR ART
FIG. 2 is an exploded perspective view of a second conventional heat dissipation fan in accordance with the prior art.
Figure 3:
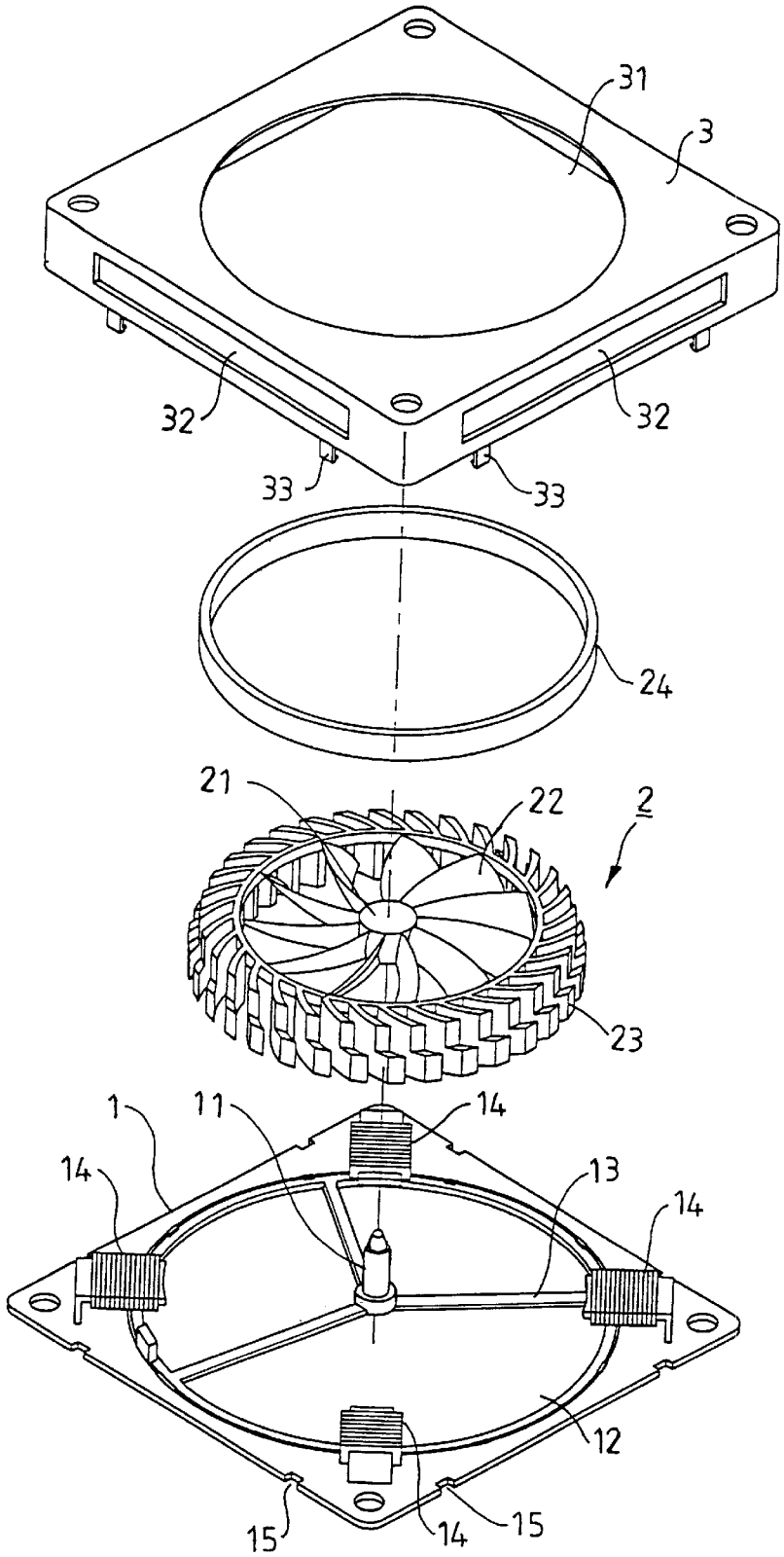
FIG. 3 is an exploded perspective view of a composite heat dissipation fan in accordance with a first embodiment of the present invention.

Referring to the drawings and initially to FIG. 3, a composite heat dissipation fan in accordance with a first embodiment of the present invention comprises a base plate 1, an impeller 2, and an outer frame 3.

The base plate 1 itself has a rotation shaft 11 for supporting the impeller 2 to rotate. The rotation shaft 11 is supported by a plurality of rods 13 and is connected to the base plate 1. The rotation shaft 11 has a periphery formed with a wind outlet opening 12 on the base plate 1. In addition, the base plate 1 is provided with a plurality of stator coils 14.

Figure 6:
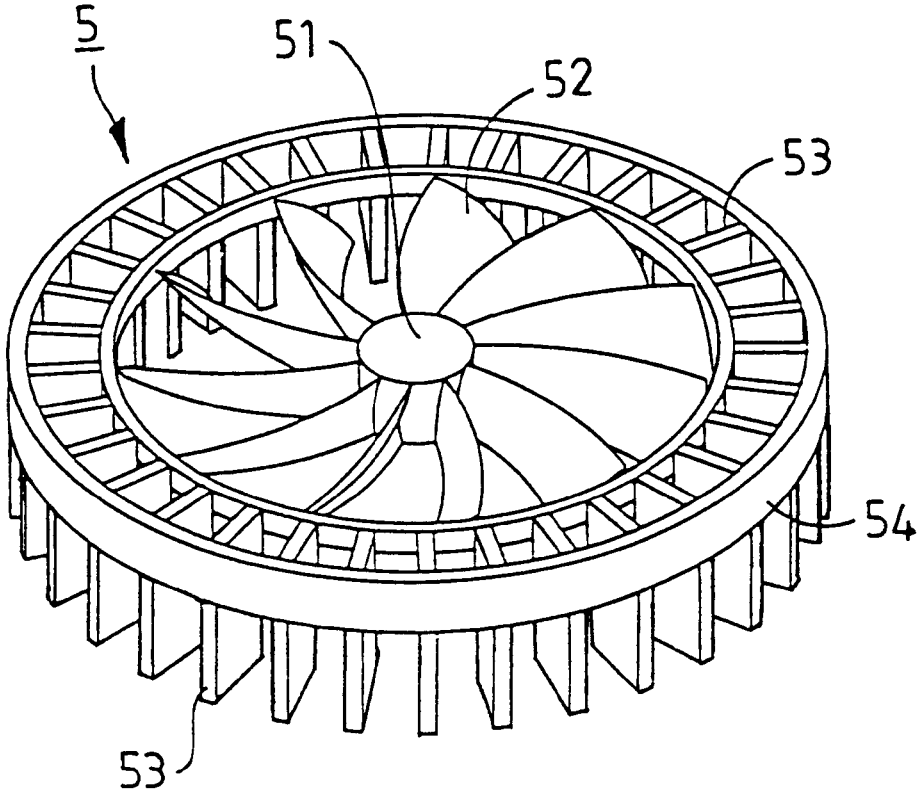
FIG. 6 is a perspective view of an impeller of a composite heat dissipation fan in accordance with a second embodiment of the present invention.

The impeller 2 has a central hub 21 rotatably mounted on the rotation shaft 11 of the base plate 1, and a conventional bearing structure may be mounted therebetween. The central hub 21 of the impeller 2 is provided with a plurality of radially directed first blades 22 which may be a conventional axial flow typed blade. The first blades 22 has a periphery combined with second blades 23 for creating a side directed wind supply. The second blade 23 is a multi-wing typed blade, and may be a centrifugal typed blade, and may be a flat plate typed blade as shown in FIG. 6. The impeller 2 is provided with a magnet ring 24 which may be induced with the stator coils 14 of the base plate 1, to drive the impeller 2 to rotate.

The outer frame 3 may be combined with the base plate 1, and the combination thereof may use various combining methods. In the preferred embodiment, the outer frame 3 is provided with hooks 33 each of which is snapped on a snap portion 15 of the base plate 1. The outer frame 3 is provided with a wind inlet opening 31 which corresponds to the first blades 22 of the impeller 2, and the outer frame 3 has side wall faces each formed with a wind outlet opening 32 which corresponds to the position of the second blade 23 of the impeller 2.

Figure 4:
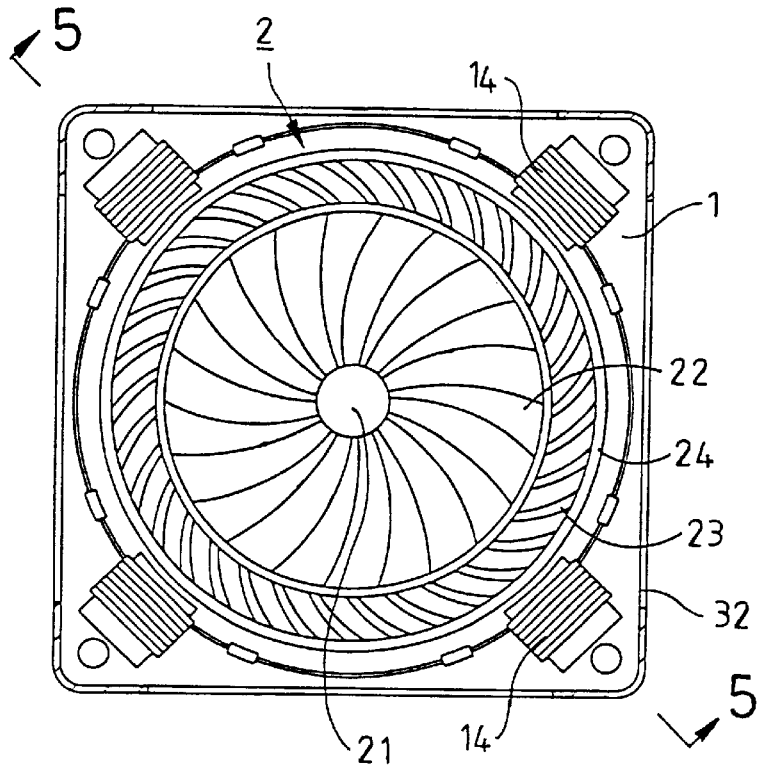
FIG. 4 is a top plan assembly view of the composite heat dissipation fan as shown in FIG. 3.
Figure 5:
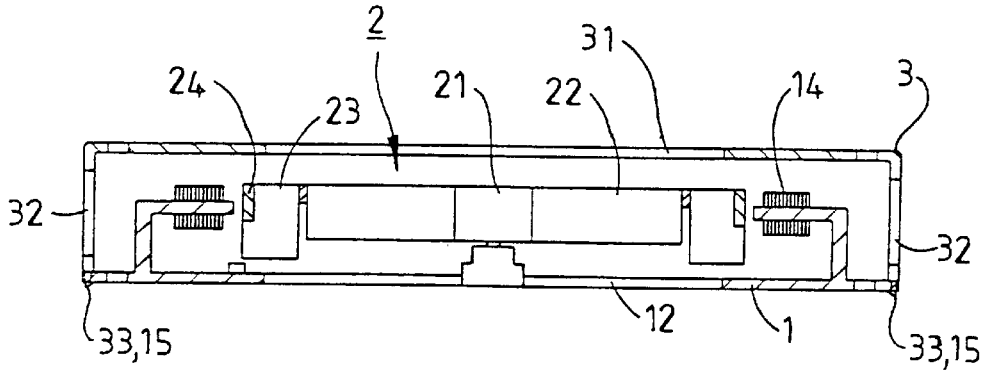
FIG. 5 is a cross-sectional view of the composite heat dissipation fan along line 5—5 as shown in FIG. 4.

Referring to FIGS. 4 and 5, when the embodiment is operated, the stator coils 14 of the base plate 1 are initially energized, so as to induce with the magnet ring 24 of the impeller 2, so that the impeller 2 is driven to rotate, while the first blades 22 and the second blades 23 of the impeller 2 are also rotated simultaneously. Meanwhile, the ambient cold air is introduced through the wind inlet opening 31 of the outer frame 3 by rotation of the first blades 22, while the wind is drained downward through the wind outlet opening 12 of the base plate 1. At the same time, the ambient cold air drawn into the base plate 1 will create a sideward wind drain action by rotation of the second blades 23, and the wind is drained outward through the wind outlet openings 32 of the side wall faces of the outer frame 3. Accordingly, when the embodiment is operated, the heat produced by the heat emitting body is carried away through a multi-directional path including the downward direction and the sideward direction, thereby efficiently enhancing the entire cooling and heat dissipation efficiency.

Figure 7:
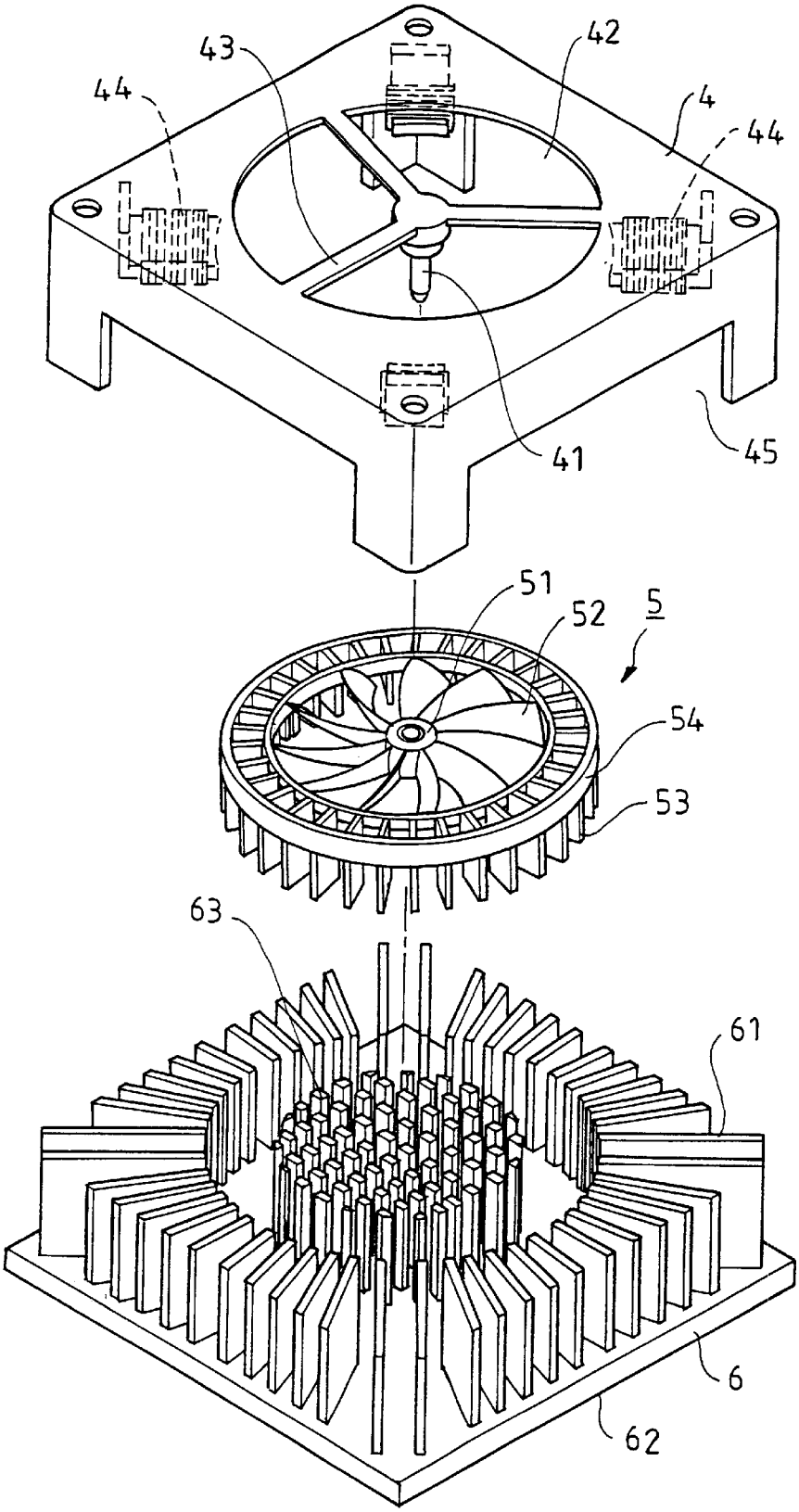
FIG. 7 is an exploded perspective view of a composite heat dissipation fan in accordance with a second embodiment of the present invention.
Figure 8:
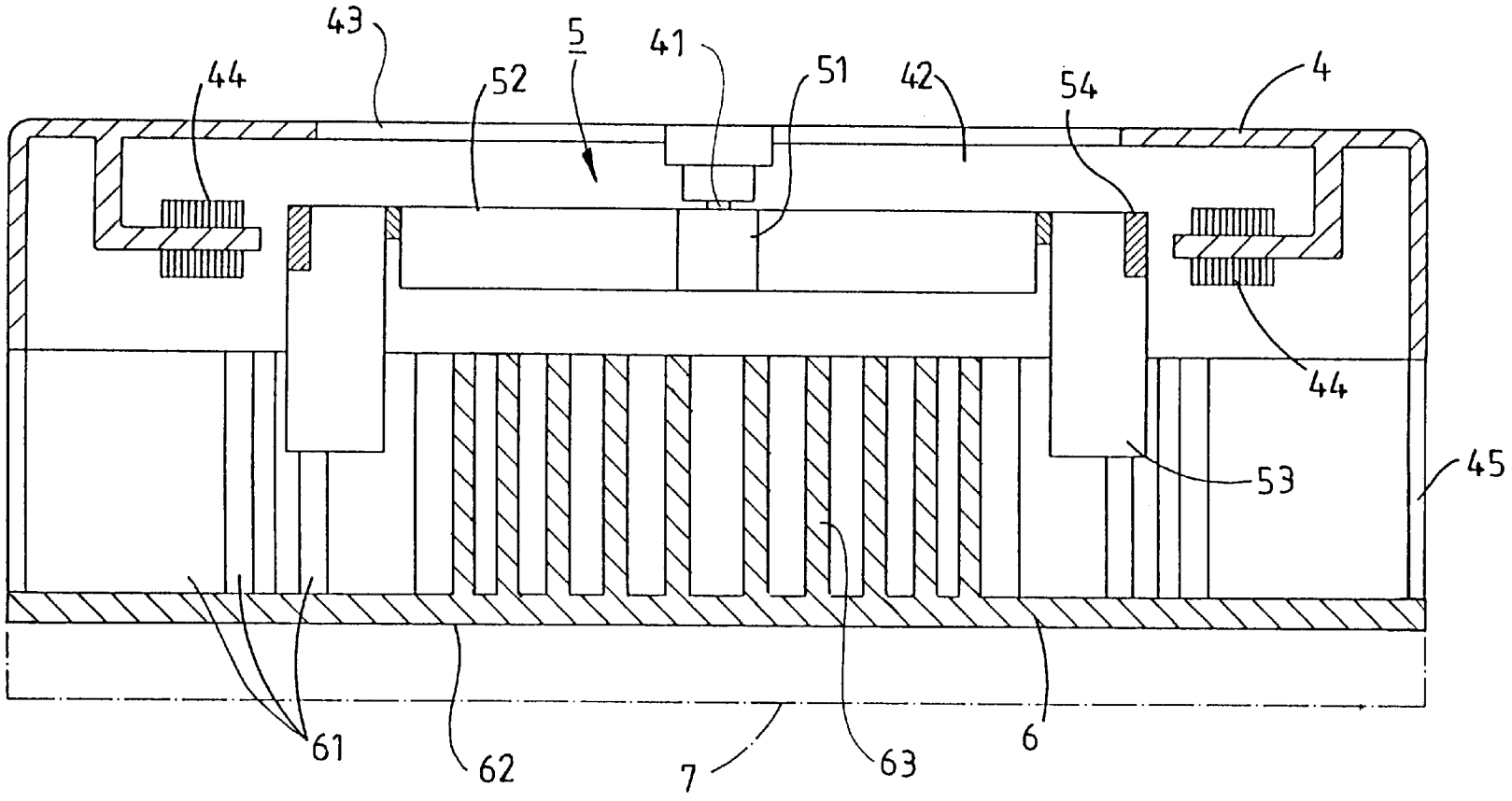
FIG. 8 is a front plan cross-sectional assembly view of the composite heat dissipation fan as shown in FIG. 7.

Referring to FIGS. 7 and 8, a composite heat dissipation fan in accordance with a second embodiment of the present invention comprises a base plate 4, an impeller 5, and a heat dissipation seat 6.

The base plate 4 includes rods 43 for supporting a rotation shaft 41 which may support the impeller 5 to rotate. The rotation shaft 41 of the base plate 4 has a periphery formed with a wind inlet opening 42 for sucking the air flow and a wind outlet opening 45 for outputting the air flow. The base plate 4 is provided with stator coils 44.

The impeller 5 has a central hub 51 rotatably mounted on the rotation shaft 41 of the base plate 4, and a conventional bearing structure may be mounted therebetween. The central hub 51 of the impeller 5 is provided with a plurality of radially directed first blades 52 which may be a conventional axial flow typed blade. The first blades 52 has a periphery combined with second blades 53 for creating a side directed wind supply. The second blade 53 is a multi-wing typed blade, and may be a centrifugal typed blade, and may be a flat plate typed blade as shown in FIG. 6. The second blade 53 has a bottom edge extending downward to protrude outward from the wind outlet opening 45 of the base plate 4. The impeller 5 is provided with a magnet ring 54 which may be induced with the stator coils 44 of the base plate 4, to drive the impeller 5 to rotate.

The base plate 4 is combined with a heat dissipation seat 6. The heat dissipation seat 6 includes a plurality of heat dissipation pieces 61, thereby increasing the heat dissipation area. The heat dissipation seat 6 may define a receiving space into which the second blades 53 of the impeller 5 extends to rotate therein, and some of the heat dissipation pieces 61 extend into the inner edge of the impeller 5 to be surrounded by the impeller 5. The heat dissipation base has an abutment 62 for allowing abutting of a heat emitting member 7 of a central processing unit.

Referring to FIG. 8, when the embodiment is operated, the stator coils 44 of the base plate 4 are initially energized, so as to induce with the magnet ring 54 of the impeller 5, so that the impeller 5 is driven to rotate, while the first blades 52 and the second blades 53 of the impeller 5 are also simultaneously rotated. Meanwhile, the ambient cold air is introduced through the wind inlet opening 42 of the base plate 4 by rotation of the first blades 52, while the wind is drained downward through the wind outlet opening 45 of the base plate 4. At the same time, the ambient cold air drawn into the base plate 4 will create a sideward wind drain action by rotation of the second blades 53. The bottom edge of the second blade 53 extends downward to protrude outward from the wind outlet opening 45 of the base plate 4, so that the sent air flow will create a sideward wind draining effect outside of the base plate 4 (namely, inside of the heat dissipation seat 6). Meanwhile, the heat produced by the heat emitting member 7 combined under the heat dissipation seat 6 is conducted to the heat dissipation pieces 61 of the heat dissipation seat 6, and will be carried away by the air flow generated by rotation of the first blades 52 and the second blades 53 of the impeller 5, to be drained outward to the environment from the side faces of the heat dissipation seat 6 by means of the sideward wind draining effect, thereby achieving the cooling and dissipating effects. Accordingly, when the embodiment is operated, the heat produced by the heat emitting body may be carried away through a multi-directional path including the downward direction and the sideward direction, thereby efficiently enhancing the entire cooling and heat dissipation efficiency.

The present invention is disclosed in claim 1, wherein, the ambient cold air is introduced through the wind inlet opening of the outer frame by rotation of the first blades, while the wind is drained downward through the wind outlet opening of the base plate. At the same time, by rotation of the second blades, part of the cold air is drained outward through the wind outlet openings of the side wall faces of the outer frame to create a sideward wind drain action, so that the heat produced by the heat emitting body is carried away through a multi-directional path including the downward direction and the sideward direction, thereby efficiently enhancing the entire cooling and heat dissipation efficiency. Especially, the impeller has a smaller central hub, therefore, the length of the first blade is increased, thereby greatly increasing the amount of drainage.

The present invention is disclosed in claim 2, wherein, the second blade is a flat plate typed blade, so that part of the cold air is drained outward through the wind outlet openings of the side wall faces of the outer frame to create a sideward wind drain action.

The present invention is disclosed in claim 3, wherein, the second blade is a multi-wing typed blade, so that part of the cold air is drained outward through the wind outlet openings of the side wall faces of the outer frame to create a sideward wind drain action.

The present invention is disclosed in claim 4, wherein, the second blade is a centrifugal typed blade, so that part of the cold air is drained outward through the wind outlet openings of the side wall faces of the outer frame to create a sideward wind drain action.

The present invention is disclosed in claim 5, wherein, the first blade is an axial flow typed blade, so that the ambient cold air can be exactly drawn into the wind inlet opening of the outer frame, and drained downward through the wind outlet opening of the base plate.

The present invention is disclosed in claim 6, wherein, the ambient cold air is drawn into the wind inlet opening of the outer frame by rotation of the first blades, and is drained downward through the wind outlet opening of the base plate. At the same time, by rotation of the second blades, part of the cold air is drained outward through the wind outlet openings of the side wall faces of the outer frame to create a sideward wind drain action, so that the heat produced by the heat emitting body is carried away through a multi-directional path including the downward direction and the sideward direction, thereby efficiently enhancing the entire cooling and heat dissipation efficiency. Especially, the impeller has a smaller central hub, therefore, the length of the first blade is increased, thereby greatly increasing the amount of drainage.

The present invention is disclosed in claim 7, wherein, the composite heat dissipation fan is directly combined with a heat dissipation seat, therefore, the heat produced by a heat emitting member combined on the heat dissipation seat is dissipated directly and efficiently, thereby efficiently enhancing the entire cooling and heat dissipation efficiency.

The present invention is disclosed in claim 8, wherein, the bottom edge of the second blade extends to the inside of the heat dissipation seat, and some of the heat dissipation pieces extend into an inner edge of the impeller to be surrounded by the impeller, so that the heat dissipation device combined with the composite heat dissipation fan has the smallest thickness, thereby efficiently enhancing the entire cooling and heat dissipation efficiency.

The present invention is disclosed in claim 9, wherein, the heat dissipation base has an abutment, therefore, the abutment is directly rested by the heat emitting member, so that the heat produced by a heat emitting member combined on the heat dissipation seat is dissipated directly and efficiently. Although the invention has been explained in relation to its preferred embodiment as mentioned above, it is to be understood that many other possible modifications and variations can be made without departing from the scope of the present invention. It is, therefore, contemplated that the appended claim(s) will cover such modifications and variations that fall within the true scope of the invention.

What is claimed is:

1. A composite heat dissipation fan, comprising:

a base plate, having a rotation shaft, the rotation shaft having a periphery formed with a wind outlet opening, and provided with stator coils;

an impeller, having a central hub rotatably mounted on the rotation shaft of the base plate, the central hub provided with radially directed first blades, and the first blades having a periphery combined with second blades for creating side directed wind supply, the impeller provided with a magnet ring; and an outer frame, provided with a wind inlet opening which corresponds to the first blades of the impeller, in addition, the outer frame having side wall faces each formed with a side wind outlet opening which corresponds to the second blades of the impeller.

2. The composite heat dissipation fan as claimed in claim 1, wherein the second blade is a flat plate typed blade.

3. The composite heat dissipation fan as claimed in claim 1, wherein the second blade is a multi-wing typed blade.

4. The composite heat dissipation fan as claimed in claim 1, wherein the second blade is a centrifugal typed blade.

5. The composite heat dissipation fan as claimed in claim 1, wherein the first blade is an axial flow typed blade.

6. A composite heat dissipation fan, comprising:

a base plate, having a rotation shaft, the rotation shaft having a periphery formed with a wind inlet opening and a wind outlet opening, and the base plate provided with stator coils; and an impeller, having a central hub rotatably mounted on the rotation shaft of the base plate, the central hub provided with radially directed first blades, and the first blades having a periphery combined with second blades for creating side directed wind supply, the second blade having a bottom edge extending outward from the wind outlet opening of the base plate, the impeller provided with a magnet ring.

7. The composite heat dissipation fan as claimed in claim 6, wherein the base plate is combined with a heat dissipation seat.

8. The composite heat dissipation fan as claimed in claim 7, wherein the heat dissipation seat has heat dissipation pieces, the bottom edge of the second blade extending to an inside of the heat dissipation seat, and some of the heat dissipation pieces extending into an inner edge of the impeller to be surrounded by the impeller.

9. The composite heat dissipation fan as claimed in claim 7, wherein the heat dissipation base has an abutment.

* * * * *